US011357298B2

(12) United States Patent
Phillips et al.

(10) Patent No.: US 11,357,298 B2
(45) Date of Patent: Jun. 14, 2022

(54) ARTICLE OF LUGGAGE WITH A BOTTOM TRAY

(71) Applicant: TRAVELPRO PRODUCTS, INC., Boca Raton, FL (US)

(72) Inventors: Juan Phillips, Boca Raton, FL (US); Jonathan Payne, Lake Worth, FL (US)

(73) Assignee: TRAVELPRO PRODUCTS, INC.

( * ) Notice: Subject to any disclaimer, the term of this patent is extended or adjusted under 35 U.S.C. 154(b) by 243 days.

(21) Appl. No.: 16/806,724

(22) Filed: Mar. 2, 2020

(65) Prior Publication Data

US 2020/0275748 A1 Sep. 3, 2020

Related U.S. Application Data

(60) Provisional application No. 62/812,291, filed on Mar. 1, 2019.

(51) Int. Cl.

| | |
|---|---|
| ***A45C 5/14*** | (2006.01) |
| ***A45C 13/36*** | (2006.01) |
| ***A45C 5/03*** | (2006.01) |

(52) U.S. Cl.

CPC ..... *A45C 5/14* (2013.01); *A45C 5/03* (2013.01); *A45C 13/36* (2013.01); *A45C 2005/035* (2013.01)

(58) Field of Classification Search

CPC ..... A45C 2005/035

See application file for complete search history.

(56) References Cited

U.S. PATENT DOCUMENTS

| | | | |
|---|---|---|---|
| 1,762,527 | A | 6/1930 | Robinson |
| 2,440,138 | A | 4/1948 | Benefeld |
| 5,047,001 | A | 9/1991 | Willis |
| 5,048,649 | A | 9/1991 | Carpenter et al. |
| 5,113,983 | A | 5/1992 | Workman |
| 5,181,590 | A | 1/1993 | Carpenter et al. |
| 5,445,267 | A | 8/1995 | Biafore, Jr. |
| 5,529,156 | A | 6/1996 | Yang |
| 5,634,538 | A | 6/1997 | Tsai |
| 5,924,533 | A | 7/1999 | Cnockaert et al. |
| 6,148,973 | A | 11/2000 | Chang |
| 6,325,189 | B1 | 12/2001 | King et al. |

(Continued)

FOREIGN PATENT DOCUMENTS

| | | |
|---|---|---|
| CN | 204363181 U | 6/2015 |
| DE | 8904681 U1 | 9/1989 |

(Continued)

OTHER PUBLICATIONS

U.S. Appl. No. 15/516,547, Article of Luggage and Method of Assembling, filed Apr. 3, 2017.

(Continued)

*Primary Examiner* — John K Fristoe, Jr.
*Assistant Examiner* — Justin Caudill
(74) *Attorney, Agent, or Firm* — Perry + Currier Inc.

(57) ABSTRACT

An article of luggage includes a wall including flaps extending therefrom and a bottom tray. The bottom tray includes a fastener on an inside of the bottom tray to fasten the flaps to the bottom tray, integrated wheel wells, and slots to receive the flaps extending from the wall and allow the flaps to pass from an outside of the bottom tray to the inside of the bottom tray to attach the wall to the bottom tray.

14 Claims, 5 Drawing Sheets

(56) References Cited

U.S. PATENT DOCUMENTS

| | | | | |
|---|---|---|---|---|
| 7,252,296 | B2 | 8/2007 | Miyoshi | |
| 7,692,107 | B1 | 4/2010 | Shotey et al. | |
| D742,345 | S | 11/2015 | Aronoff et al. | |
| 9,549,597 | B2 | 1/2017 | Meersschaert et al. | |
| 9,675,154 | B2 | 6/2017 | Tong | |
| 2005/0056510 | A1 | 3/2005 | Hsieh | |
| 2006/0180422 | A1 | 8/2006 | Lin | |
| 2007/0175719 | A1 | 8/2007 | Lai | |
| 2009/0000894 | A1 | 1/2009 | Middup | |
| 2009/0314596 | A1 | 12/2009 | Miyoshi | |
| 2014/0041978 | A1 | 2/2014 | Chang | |
| 2014/0097053 | A1 | 4/2014 | Huang | |
| 2014/0151174 | A1 | 6/2014 | Briccola | |
| 2014/0166417 | A1 | 6/2014 | De Taeye et al. | |
| 2014/0216875 | A1 | 8/2014 | Cavalheiro | |
| 2016/0128442 | A1 | 5/2016 | Correll et al. | |
| 2016/0206069 | A1 | 7/2016 | Tong | |
| 2018/0235334 | A1* | 8/2018 | Rankin | A45C 13/36 |

FOREIGN PATENT DOCUMENTS

| | | | |
|---|---|---|---|
| DE | 8911249 | U1 | 1/1990 |
| DE | 102007046362 | A1 | 4/2009 |
| FR | 2922733 | C2 | 5/2009 |
| WO | WO-03063637 | A2 | 8/2003 |
| WO | WO-2013169360 | A1 | 11/2013 |

OTHER PUBLICATIONS

"Maxlite 3 Exapnadable 21" Spinner Carry on Suitcase Travelpro http://www.goinginstyle.mobi/products/maxlite-3-expandable-spinner-21-carry-on-suitcase-travelpro, Retrieved on Nov. 28, 2014.

NLDA Video Library, Mosaic Travel Gear, "Mosaic travel collection 1280x720.", Youtube, (Nov. 5, 2013), URL: https://www.youtube.com/watch?v=ccRXaaR7GD0, Retrieved from the Internet on Aug. 4, 2015.

AUIPO, First Examination Report, Jul. 8, 2019, re Australian Patent Application No. 2015324614.

PRV, Search Report, Dec. 11, 2019, re Swedish Patent Application No. 1750528-0.

USPTO, Final Rejection, Mar. 5, 2020, re U.S. Appl. No. 15/516,547.

Mosaic travel collection 1280x720. YouTube [online]. Mosaic Travel Gear, Nov. 5, 2013 [retrieved on Aug. 4, 2015]. Retrieved from the Internet: <URL:https://www.youtube.com/watch?v=ccRXaaR7GD)>.

International Search Report and Written Opinion of the International Searching Authority dated Aug. 13, 2015 for PCT International Application No. PCT/US2015/030484.

USPTO, Election/Restriction Requirement, dated Nov. 27, 2018, re U.S. Appl. No. 15/516,547.

USPTO, Non-Final Rejection, dated Apr. 17, 2019, re U.S. Appl. No. 15/516,547.

USPTO, Final Rejection, dated Nov. 27, 2019, re U.S. Appl. No. 15/516,547.

UKIPO, Examination Report under Section 18(3), dated Jan. 31, 2020 re UK Patent Application No. 1706879.2.

* cited by examiner

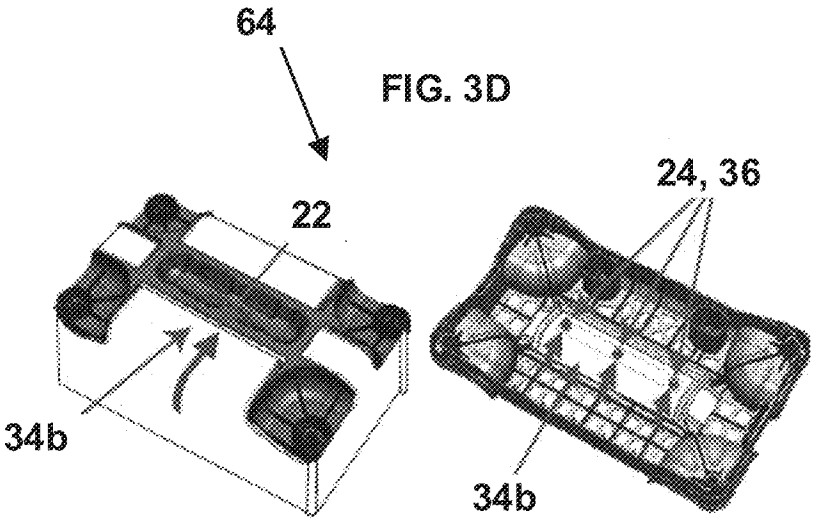
FIG. 3D
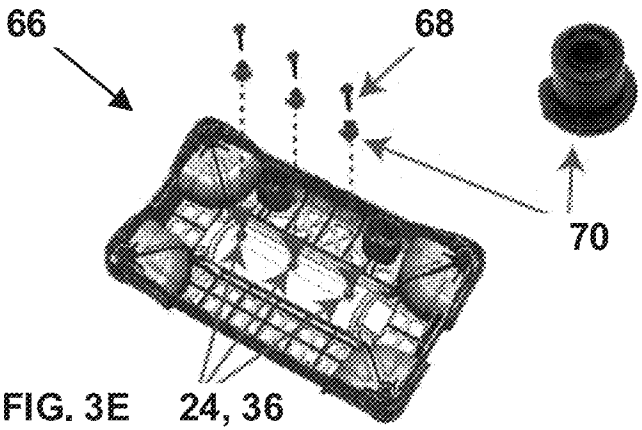
FIG. 3E
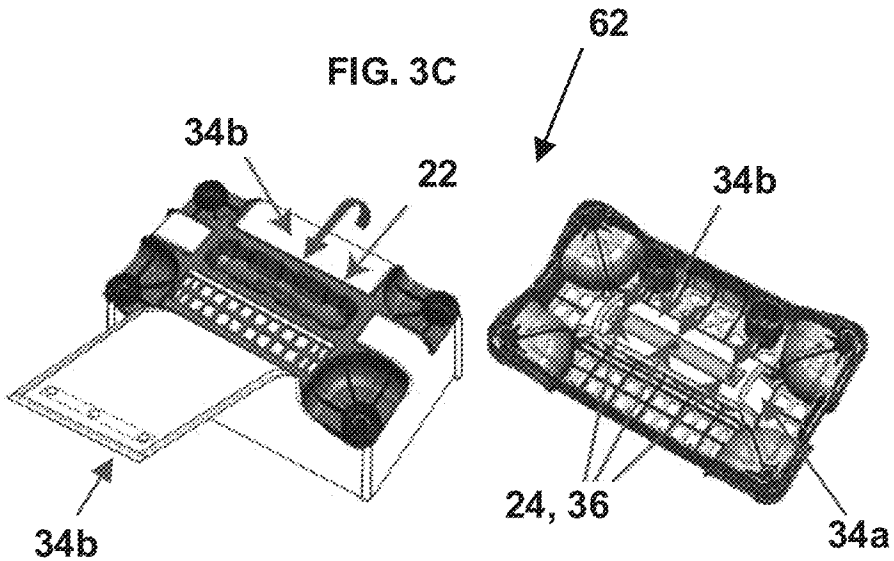
FIG. 3C
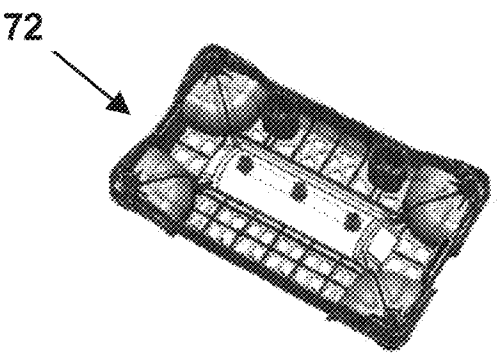

ARTICLE OF LUGGAGE WITH A BOTTOM TRAY

CROSS-REFERENCE TO RELATED APPLICATION

This application claims the benefit of U.S. provisional application Ser. No. 62/812,291, filed Mar. 1, 2019, which is incorporated herein by reference.

FIELD

The present disclosure relates generally to luggage and more specifically to softside luggage that has spinner wheels.

BACKGROUND

Travel is a common human activity and luggage is an important feature of travel. Development of new luggage as well as new methods of assembling luggage is quite active as there is a growing demand for more durable and lighter luggage as well as a desire to manufacture the luggage with a high degree of consistency for a low cost. Presently, softside articles of luggage have become very popular for their durability and lightweight. This has naturally resulted in an increase in the need for durable, cost-effective parts and the level of ease required to assemble them to form an article of luggage.

BRIEF DESCRIPTION OF THE DRAWINGS

Non-limiting embodiments will now be described, by way of example only, with reference to the attached Figures.

FIG. 3C depicts a subsequent step of the method started at FIG. 3A, specifically, the insertion of another flap of wall material into a slot in the bottom tray and the temporary securement of the flap to the bottom tray.

FIG. 3D depicts a subsequent step of the method started at FIG. 3A, specifically, the insertion of another flap of wall material into a slot in the bottom tray and the temporary securement of the flap to the bottom tray.

FIG. 3E depicts a subsequent step of the method started at FIG. 3A, specifically, the permanent securement of the flaps of wall material to the bottom tray.

DETAILED DESCRIPTION

In accordance with an aspect of this disclosure, an article of luggage includes a wall and a bottom tray. The bottom tray includes a plurality of slots for receiving flaps extending from the wall, a plurality of fasteners for fastening the wall material to the bottom tray, and a plurality of integrated wheel wells. The slots in the bottom tray allow the flaps to extend into the article of luggage, so that their ends may be hidden, thereby providing an improved appearance. The fasteners provide temporary and permanent securement of the flaps to the bottom tray during manufacture and use of the article of luggage. The slots and fasteners provide for simplified manufacture, durable construction, and attractive appearance.

The material of the bottom tray may include a hard plastic. The material of the bottom tray may include a lightweight metal. The wall material may include fabric.

The bottom tray may include a unitary construction. The bottom tray may be manufactured using an injection molding process. The bottom tray may include a secure attachment point for a telescopic handle.

The bottom tray may include a plurality of apertures to reduce the weight in the article of luggage. The bottom tray may include a reinforcing section. The reinforcing section of the bottom tray may include a ridge.

The bottom tray may include a plurality of interlock extensions that are integrated with the plurality of integrated wheel wells to enhance securing of the wall to the bottom tray.

The plurality of fasteners may include a plurality of bosses. Each of the plurality of bosses may further be raised to mate with a hole in the wall material. Each of the plurality of bosses may further temporarily hold down the wall material during the fastening process.

Figure 1:
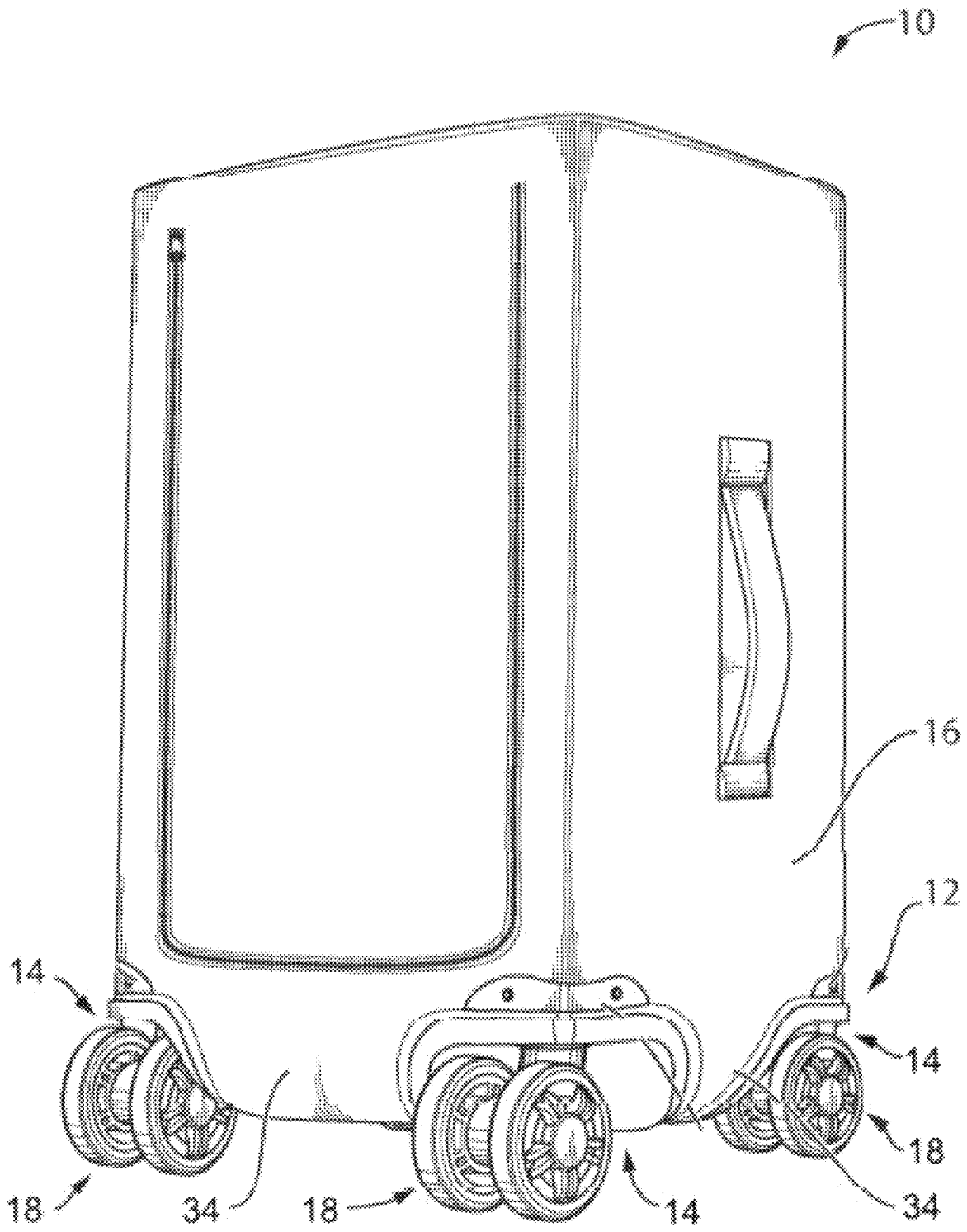
FIG. 1 is a perspective view of an example article of luggage according to an embodiment.

Referring now to FIG. 1, an example assembled article of luggage 10 is generally shown. The article of luggage 10 includes a bottom tray 12 with integrated wheel wells 14, a wall 16, spinner wheels 18, and flaps 34 extending from the wall 16. The flaps 34 are connected to the bottom tray 12. It is important to note that the wheel wells 14 are integrated with the bottom tray 12 of the article of luggage 10. That is, the wheel wells 14 are of unitary/monolithic construction with the bottom tray 12. The bottom tray 12 with integrated wheel wells 14 allow the article of luggage 10 to be more durable and lighter in weight.

Further details concerning the article of luggage 10 are described in U.S. patent application Ser. No. 15/516,547, which is incorporated herein by reference.

Figure 2B:
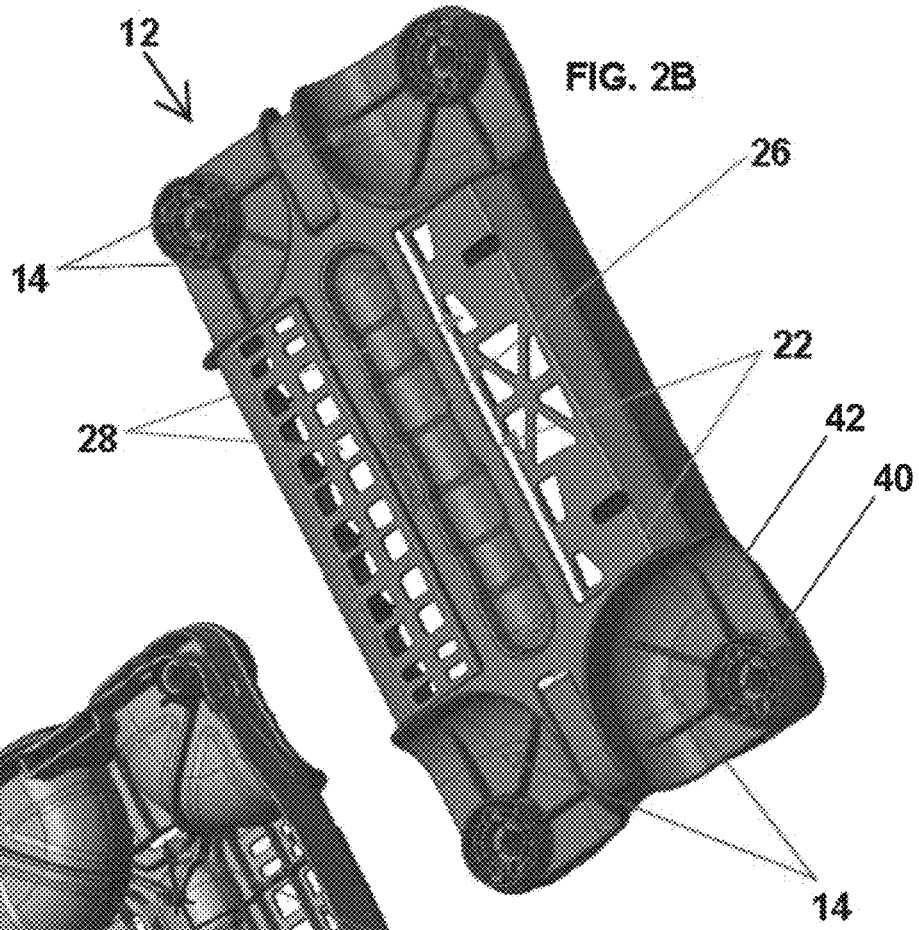
FIG. 2B is a bottom perspective view of the example bottom tray of FIG. 2A.
Figure 2A:
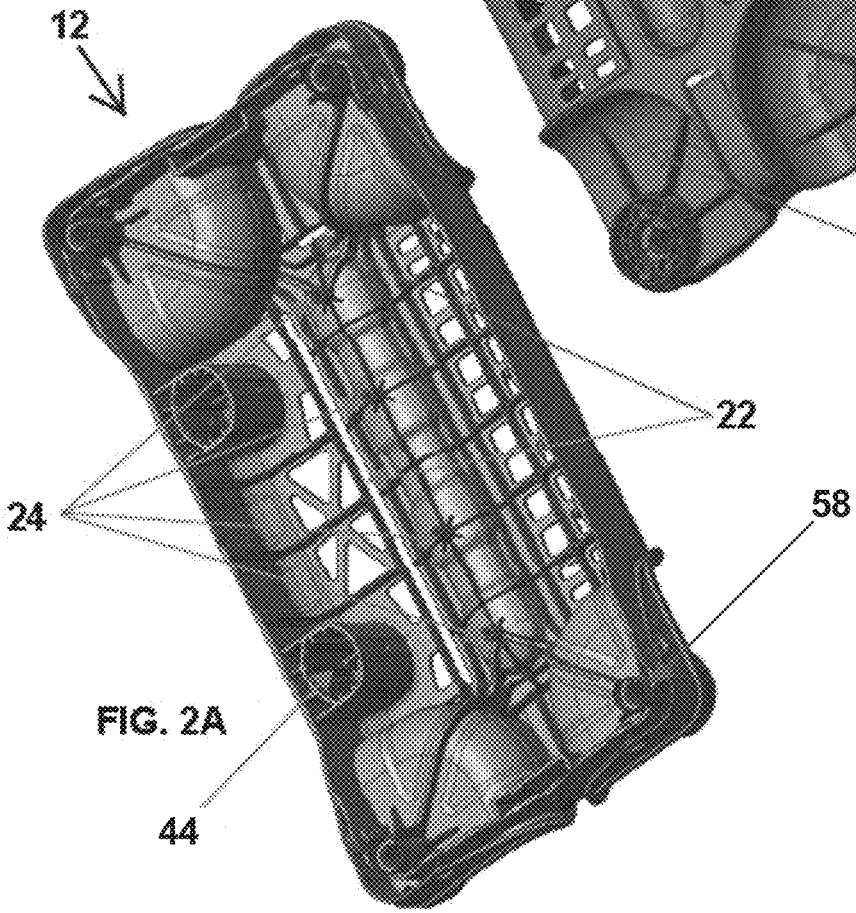
FIG. 2A is a top perspective view of an example bottom tray of the article of luggage of FIG. 1.

Referring now to FIG. 2A and FIG. 2B, an example of a bottom tray 12 for an article of luggage 10 is generally shown. The bottom tray 12 includes a plurality of slots 22, a plurality of wheel wells 14, and a reinforcing section 26.

Each of the wheel wells 14 is shaped to at least partially accommodate the respective spinner wheel 18. In the present embodiment, each of the wheel wells 14 defines a concave cavity configured to directly receive the respective spinner wheel 18. It is to be appreciated with the benefit of this description that the depth of the wheel well 14 is not particularly limited and that the wheel well 14 is not necessarily concave in other embodiments. Some embodiments can include a convex wheel well such that the wheels extend further from the wall 16. For example, when the wheel well 14 includes a deep cavity, the spinner wheels 18 are generally further recessed resulting in the external dimensions of the article of luggage 10 being smaller which can be advantageous in some circumstances, such as for satisfying airline luggage size requirements. However, the deeper recess would reduce the interior space of the article of luggage 10 and create irregular features, such as a bump, on the interior walls of the article of luggage 10 making it more difficult to utilize the interior space when loading non-deformable objects. Conversely, having a shallow cavity for the wheel well 14 would allow for the article of luggage 10 to be positioned further above a surface such that the wall 16 would be less likely to touch the surface to reduce the chance that the wall 16 would be damaged or soiled from contact with the surface. In addition, the shallower wheel well 14 would provide interior walls which are flatter, and which may facilitate loading of the article of luggage 10.

Each wheel well 14 includes a wheel securement fixture 40 to receive a post of a spinner wheel 18 to allow the spinner wheel 18 to change direction. Reinforcement ribs 42 may extend from the wheel securement fixture 40 along the inside of the well 14 to provide rigidity.

The bottom tray 12 may also include a plurality of apertures 28 extending through the bottom tray 12. The apertures 28 reduce the weight of the bottom tray 12. The plurality of apertures 28 may be substantially the same or they may differ in shape. The bottom tray 12 may also include handle attachment points 44 for a telescopic handle that may be used with the article of luggage 10. Handle attachment points 44 provide a rigid connection between the telescopic handle and the bottom tray 12, to increase overall rigidity of the article of luggage.

As shown in FIG. 1, the wall 16 material of the article of luggage is shaped to have at least one extending fastening flap 34 for attachment to the bottom tray 12. The fastening flap 34 is narrower than the wall 16 and is wrapped at least partially under the bottom tray 12. The fastening flap 34 may be secured to the bottom tray 12 using the plurality of fasteners 24, shown in FIG. 2A.

Each slot 22 of the bottom tray receives a flap 34 extending from the wall 16 material. Each of the plurality of slots 22 may differ in length and position, relative to the bottom tray 12, or they may be substantially similar in position and length. The plurality of slots 22 may be sized proportionally to the outer edge of the bottom tray 12, such that slots 22 located parallel to shorter edges of the bottom tray 12 may be shorter than the slots 22 located parallel to the longer edges of the bottom tray 12. Each of the plurality of slots 22 may be wide enough to allow the respective flap 34 to pass and narrow enough to avoid intrusion of dust or debris.

The wall 16 may be softer than the material of the bottom tray. Example wall materials include fabric, including, but not limited to, leather, synthetic fabric, natural fabric, or similar.

Figure 3B:
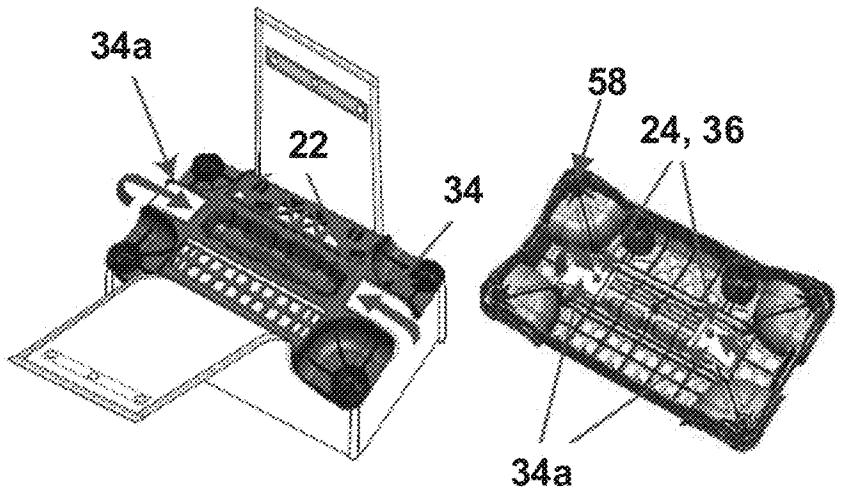
FIG. 3B depicts a subsequent step of the method started at FIG. 3A, specifically, the insertion of a flap of wall material into a slot in the bottom tray and the temporary securement of the flap to the bottom tray.
Figure 3A:
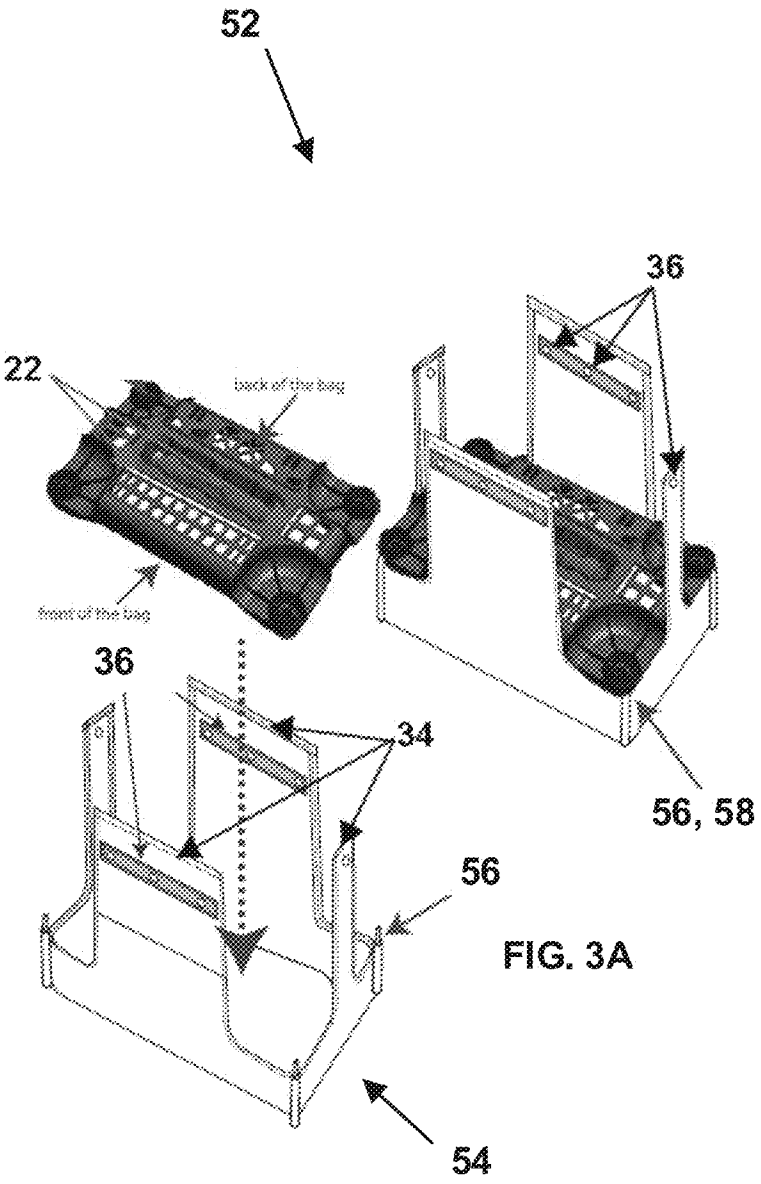
FIG. 3A depicts the start of an example method of assembling a wall to a bottom tray for an article of luggage, specifically, the insertion of the bottom tray into a rectangular opening defined by the wall.

A plurality of fasteners 24 are also shown in FIG. 2A. The plurality of fasteners 24 may include bosses (for example, raised portions of material, which may be able to receive attachment of a top-hat screw cap and screw) or the like, each of which are able to mate with a hole 36 (in FIG. 3A) in the flap 34 of wall material.

A reinforcing section 26 is also shown in FIG. 2B. This reinforcing section 26 provides additional support to the bottom tray 12 both generally, and especially when the article of luggage contains heavy items. The reinforcing section 26 may take the form of a ridge or similar concave or convex structure. The shape of the reinforcing section 26 may vary, and in one embodiment the reinforcing section 26 may include an elongated curved protrusion that protrudes toward the top of the article of luggage 10. The reinforcing section 26 may be located substantially in the center of the bottom tray 12, so as to evenly provide support to the bottom tray 12.

The plurality of fasteners 24 may be positioned at or near the peak of the reinforcing section 26, so that the fasteners 24 are raised with respect to a bottom of the bottom tray 12 and thus readily accessible to a worker manufacturing the article of luggage.

The plurality of fasteners 24 may be used to secure each of flap 34 both for a temporary duration and permanently. This provides an assembler with the option to temporarily fasten a flap 34, adjust or fasten another flap 34 to a suitable position and still be able to adjust the initial flap 34 as well.

Referring now to FIGS. 3A-3E, an example method of assembling a wall 16 to a bottom tray 12 for an article of luggage 10 is depicted.

At step 52, the bottom tray 12 is laid into the bottom of an incomplete bag 54 formed of a wall 16 using guide rods 56, or similar technique, to line the bottom tray 12 up with the inside of the incomplete bag 54. Prior to insertion of the bottom tray 12, the wall 16 of the incomplete bag 54 is partially sewn together, so as to form a generally rectangular opening to receive the bottom tray 12. Guide rods 56 may be inserted into slots formed by material of the incomplete bag 54 to provide rigidity to the bag and to provide a connection with the bottom tray 12. The bottom tray 12 is inserted into rectangular opening and the ends of the guide rods 56 may be secured into holes 58 provided in the bottom tray 12, as shown in FIG. 2A.

At step 60, side flaps 34*a* of wall material are wrapped around the outside of the bottom tray 12 and are then slid through corresponding side slots 22 in the bottom tray 12. The side flaps 34*a* are laid over fasteners 24 on the inside of the bottom tray 12. Holes 36 in the side flaps 34*a* may be fit over the fasteners 24 (e.g., bosses), so as to temporarily secure the flaps 34*a* to the bottom tray 12.

At steps 62 and 64, front and rear flaps 34*b* of wall material are wrapped around the outside of the bottom tray 12 and are then slid through corresponding front and back slots 22 in the bottom tray 12. The front and rear flaps 34*b* are laid over the fasteners 24 on the inside of the bottom tray 12. The front and rear flaps 34*b* may also partially overlap the previously attached side flaps 34*a* and may share one or more fasteners 24 therewith. Holes 36 in the flaps 34*b* may be fit over the fasteners 24 (e.g., bosses), so as to temporarily secure the flaps 34*b* to the bottom tray 12.

It should be noted that steps 60, 62, 64 may be performed in any sequence. For example, front and rear flaps 34*b* may be inserted and secured first, followed by side flaps 34*a*. In other examples, flaps 34*a*, 34*b* are inserted and secured in any order, such as front, left, back, and then right.

At step 66, the fasteners 24 are completed, so that the flaps 34*a*, 34*b* are permanently secured to the bottom tray 12. Screws 68 may be used to secure top-hat screw caps 70 to the bosses 24 that hold the flaps 34*a*, 34*b*. Each top-hat screw cap 70 has a portion that is larger than the hole 36 in the flaps 34*a*, 34*b* and therefore prevent the flaps 34*a*, 34*b* from coming loose from the bosses 24. Each top-hat screw cap 70 may have a narrower portion that fits into the boss 24. Each top-hat screw cap 70 may have an unthreaded through-hole to receive a screw 68 that threads into a threaded hole in the boss 24.

The bottom tray 12 and fabric wall are then permanently assembled together, as indicated at 72.

Figure 4:
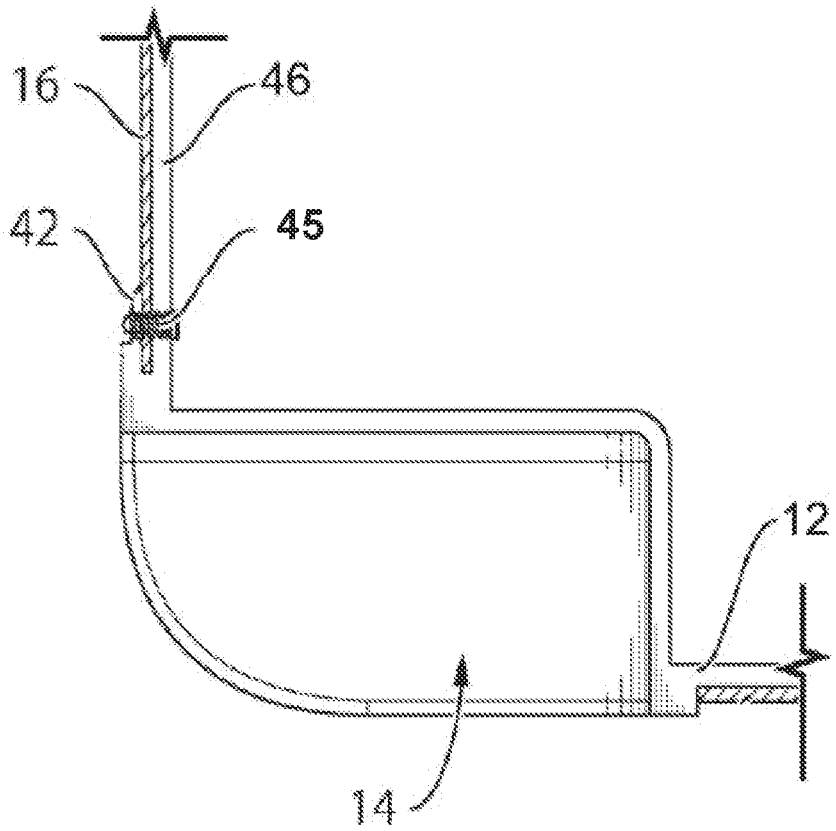
FIG. 4 is a cross section view of a portion of the article of luggage of FIG. 1.

Referring now to FIG. 4, an interlock extension 42 of a plurality of interlock extensions 42 is shown. The plurality of interlock extensions 42 may be integrated with the bottom tray 12, at the wheel wells 14. The interlock extension 42 may include one or more elastomers configured to retain the wall 16 using friction. For example, as illustrated, an interlock extension 42 may include a planar body that cooperates with a wall 46 of the bottom tray 12 to sandwich the luggage wall material 16 there-between. That is, the interlock extension 42 and the wall 46 of the bottom tray 12 may define a gap into which the wall material 16 may be secured. The interlock extension 42 may be made of a material, such as elastomer, different from the material of the bottom tray 12. The interlock extension 42 may be made integral with the bottom tray 12 by use of adhesive, thermal bonding, overmolding, etc. Each interlock extension 42 may have a plurality of interlock fasteners 45 for providing greater ability to secure the bottom tray 12 to the wall 16.

The bottom tray 12 may be made from a hard plastic, such as polypropylene, or other similar materials that are ideal for the bottom tray 12, such as, aluminum, titanium, carbon fiber composites, and other materials commonly used in the manufacture of structural components of luggage. The material of the bottom tray 12 may be substantially harder and more rigid than the material of the wall 16.

Each of the plurality of fasteners 24 may include bosses or other similar extrusions from the bottom tray 12 which are able to mate with the holes of the wall material.

The bottom tray 12 may be a unitary construction, such as an injection molded construction.

The unitary design of the bottom tray 12, coupled with the integrated wheel wells 14 and the reinforcing section 26 may provide for a much sturdier assembly in comparison to the prior art. It is to be appreciated that the wheel wells 14 are not covered by the wall 16. Accordingly, the wheel wells 14 expose the bottom tray 12 as an external surface within the wheel wells 14. It is to be appreciated by a person of skill in the art that this provides advantages in to the manufacturing of the article of luggage 10. Since the wall 16 does not overlap the wheel well 14, the attachment of the wall 16 and the spinner wheels 18 are completely independent. Therefore, the spinner wheels 18 can be directly attached to the bottom tray 12 equally easily at any time either before or after attaching the wall 16 providing greater flexibility in the manufacturing process of the article of luggage.

Increased accuracy in spinner wheel 18 positioning and orientation is also an advantage of the bottom tray 12. More accurately positioned spinner wheels 18 can help the user better control the article of luggage 10 when in motion.

The slots 22 facilitate the design of the article of luggage 10 by allowing a simple yet sturdy fastening of the wall 16 to the bottom tray 12. The plurality of slots 22 further allow the material used in the wall 16 to be folded right around the bottom tray 12 and in through it, ending with the wall 16 being fastened to the bottom tray 12 in a manner that is both effective and aesthetic, as the flaps 34 are hidden from view.

The scope of the claims should not be limited by the embodiments set forth in the above examples but should be given the broadest interpretation consistent with the description as a whole.

What is claimed is:

1. An article of luggage comprising:

a wall including flaps extending therefrom; and a bottom tray including:

a fastener on an inside of the bottom tray to fasten the flaps to the bottom tray;

a plurality of integrated wheel wells; and a plurality of slots to receive the flaps extending from the wall and allow the flaps to pass from an outside of the bottom tray to the inside of the bottom tray to attach the wall to the bottom tray.

2. The article of luggage of claim 1, wherein the fastener includes a boss.

3. The article of luggage of claim 2, wherein the boss is raised to mate with a hole in a flap extending from the wall.

4. The article of luggage of claim 2, wherein the boss is to temporarily hold down the flap extending from the wall during manufacture.

5. The article of luggage of claim 1, wherein a material of the bottom tray includes a hard plastic.

6. The article of luggage of claim 1, wherein a material of the bottom tray includes a lightweight metal.

7. The article of luggage of claim 1, wherein the wall includes a fabric.

8. The article of luggage of claim 1, wherein the bottom tray has a unitary construction.

9. The article of luggage of claim 1, wherein the bottom tray is injection molded.

10. The article of luggage of claim 1, wherein the bottom tray includes a reinforcing section.

11. The article of luggage of claim 10, wherein the reinforcing section includes a ridge.

12. The article of luggage of claim 1, wherein the bottom tray includes a plurality of apertures to reduce weight.

13. The article of luggage of claim 1, wherein the bottom tray includes a secure attachment point for a telescopic handle.

14. The article of luggage of claim 1, wherein the bottom tray includes a plurality of integrated interlock extensions.

* * * * *